US005372550A

United States Patent [19]

Gleeson et al.

[11] Patent Number: 5,372,550

[45] Date of Patent: Dec. 13, 1994

[54] PLAY APPARATUS HAVING INCLINED SURFACES FOR SLIDING AND CLIMBING

[75] Inventors: James F. Gleeson; Richard J. Petersheim; Mitchell R. Warren, all of Charlotte; Dana W. Ingold, Salisbury, all of N.C.

[73] Assignee: Restaurant Technology, Inc., Oak Brook, Ill.

[21] Appl. No.: 845,130

[22] Filed: Mar. 3, 1992

[51] Int. Cl.[5] ..... A61G 21/18; A63B 71/02; A63G 21/00

[52] U.S. Cl. ..... 472/116

[58] Field of Search ..... 472/116, 117; 482/35, 482/36, 37

[56] References Cited

U.S. PATENT DOCUMENTS

| | | | |
|---|---|---|---|
| D. 180,801 | 8/1957 | Overton | 472/116 X |
| D. 224,796 | 9/1972 | Price et al. | 482/35 X |
| 796,159 | 8/1905 | Smolik | 482/35 |
| 2,823,918 | 2/1958 | Lewis | 482/37 |
| 3,263,994 | 8/1966 | Londgren | 472/116 |
| 3,472,509 | 9/1967 | Flynn | 272/60 |
| 3,572,698 | 3/1971 | Greenly | 272/60 |
| 3,743,281 | 7/1973 | Gimbel | 472/116 |
| 3,814,416 | 6/1974 | Munger et al. | 272/56.5 |
| 4,189,149 | 2/1980 | Katsiaficas | 272/113 |
| 4,546,965 | 10/1985 | Baxter et al. | 272/56.5 |
| 4,620,843 | 11/1986 | Higginbotham, Sr. et al. | 446/94 |
| 4,630,819 | 12/1986 | Levin | 272/113 |
| 5,031,897 | 7/1991 | Zalesak | 472/116 |
| 5,167,595 | 12/1992 | Gleeson et al. | 482/35 |

*Primary Examiner*—Carl D. Friedman
*Assistant Examiner*—Beth A. Aubrey
*Attorney, Agent, or Firm*—Jenner & Block

[57] ABSTRACT

An article of play apparatus is claimed having an elevated platform and two inclined surfaces which extend downwardly from the elevated platform. Cylindrical ridges traverse the first inclined surface, and allow children to climb up the first surface toward the elevated platform. Children can then descend the second inclined surface, which includes adjacent padded rollers over which children can slide or crawl. In one embodiment, the first inclined surface is planar, but has a number of padded cylindrical wells suitable for receiving the hands and feet of a child.

4 Claims, 2 Drawing Sheets

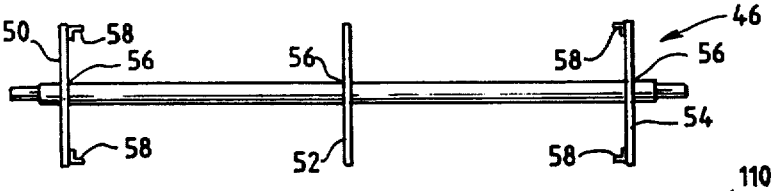
Fig. 5
Fig. 7
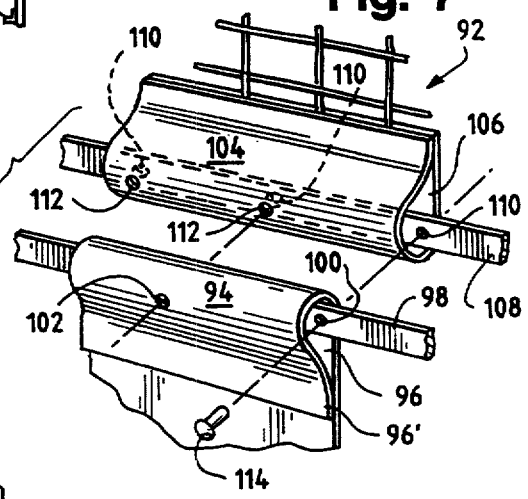
Fig. 6
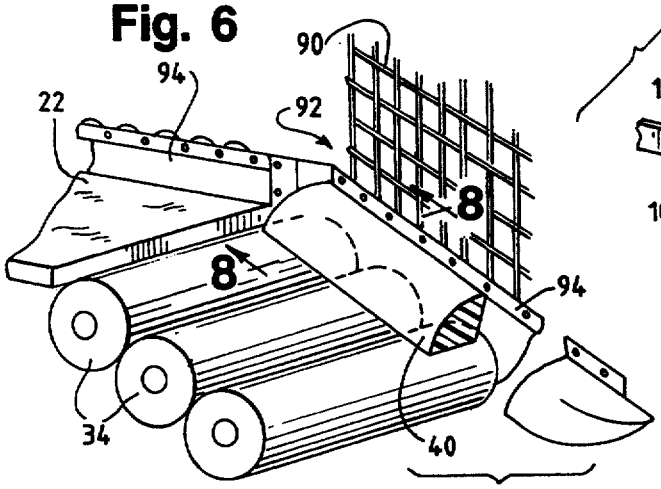
Fig. 9
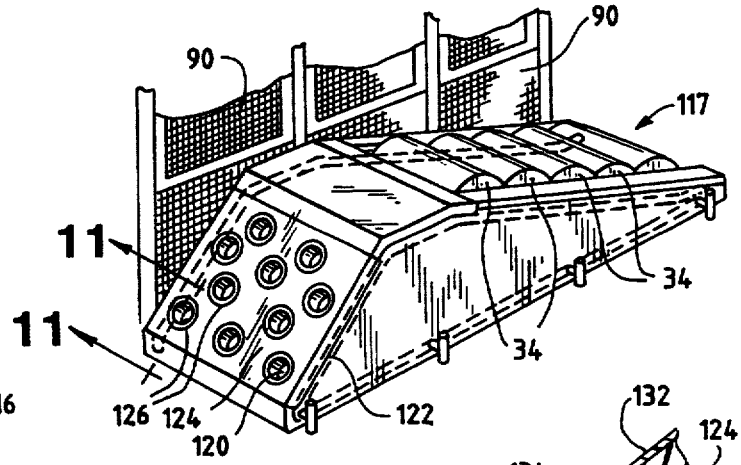
Fig. 8
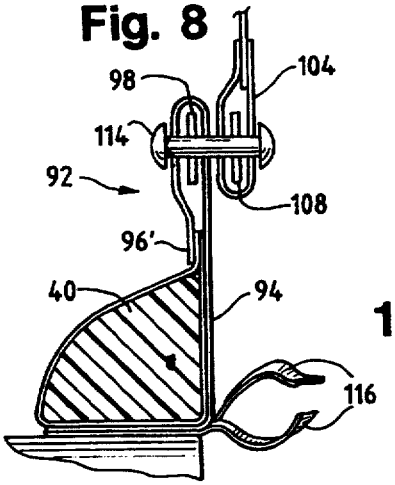
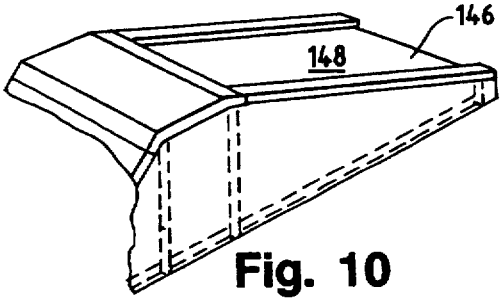
Fig. 10
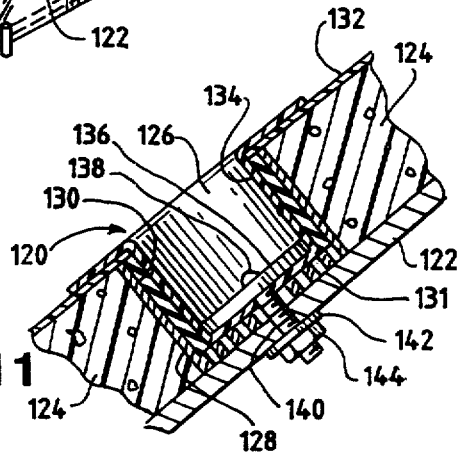
Fig. 11

PLAY APPARATUS HAVING INCLINED SURFACES FOR SLIDING AND CLIMBING

FIELD OF THE INVENTION

This invention relates to equipment particularly suited for recreational use by children. In particular, the invention relates to climbers and slides.

BACKGROUND OF THE INVENTION

While various types of children's play apparatus have been around for decades, many parents are unaware of the fundamental role play can have in a child's physical, mental and social development. Generally, many articles of play apparatus, such as well-known playground slides and monkey bars, do not offer the fullest opportunity for children to develop. Moreover, some prior art provided limited protection in the event of a fall. In particular, there is a need for play apparatus that allows children to practice climbing and balance skills, while safely taking risks. Specifically, there is a need for play apparatus that minimizes risk of injury of children playing thereon.

SUMMARY OF THE INVENTION

In accordance with the invention, play apparatus is disclosed which provides children, and particularly small children, with safe, challenging play by which the children can develop their imaginations, self-confidence, physical strength and agility, and social skills. In accordance with the invention, passive safety structures are incorporated in the design of the play apparatus.

In a first embodiment, the play apparatus has an elevated platform and two inclined surfaces which extend downwardly from the elevated platform. A plurality of cylindrical ridges or bolsters traverse the first inclined surface and are supported by a planar underlayment. The ridges allow children to climb up the first surface toward the elevated platform. The ridges are adjacent one another, and (with planar underlayment) form a continuous surface which includes a number of recessed hand and foot supports, defined by the areas between adjacent ridges. Children can then descend the second inclined surface, which includes adjacent padded rotatable members over which children can slide or crawl. To enable rotation, the rotatable members are equipped with axle assemblies having axle ends protruding from each longitudinal end of the rotatable members.

In some cases, the second inclined surface may include two inclined support members extending down from the elevated platform. The inclined support members are elongated and spaced apart. Axle mounts are spaced along the support members for rotatably mounting the padded rotatable members by their respective axle assemblies. Each mount includes a bushing which engages the axle assembly at one longitudinal end, and a clamp which mounts the bushing to one of the inclined support members. In some cases, the bushing may include a roller clutch for permitting rotation of the rotatable member in one direction only.

In a second embodiment, the first inclined surface is generally planar, but has a number of spaced, padded cylindrical wells suitable for receiving the hands and feet of a child. The wells extend over the length and width of the first inclined surface, and act as rungs for allowing children to crawl up or down the first inclined surface. In accordance with this second embodiment, the second inclined surface may have either rollers, as described above, or may be a flat sliding surface.

Because first inclined surface in both the first and second embodiment is a continuous surface, it is impossible for a child to overextend a hand or foot through the hand and foot supports. Contrastingly, a discontinuous climbing surface such as a conventional ladder or a board with holes, creates the potential for a child's limb to slip through a discontinuous portion (such as between rungs of a ladder). The absence of discontinuous portions in the first inclined surface improves the safety of the present play apparatus while increasing the child's chances of successfully negotiating the first inclined surface.

In either of the foregoing two embodiments, a frame may be provided. The frame has a base, which may be made of four elongated members connected to form a rectangle. A number of vertical members are peripherally disposed around the base and extend upward therefrom to define an interior region. Nets are strung between the vertical members to partially enclose the interior region.

The elevated platform is mounted to one of the vertical members so that the platform and the first and second inclined surfaces are disposed inside the interior region and adjacent to the nets. In some cases, the first and second surfaces have grommet-bearing flanges along their respective longitudinal edges. The nets are also provided with grommet-bearing edges. The grommets of the nets and flanges are alignable, and may be fastened together by rivets or other suitable devices. In this manner, the flanges are secured to the nets so that a child cannot fall or crawl between the play apparatus and the nets.

BRIEF DESCRIPTION OF THE DRAWINGS

FIG. 5 is a side view of the axle assembly that is part of the padded rotatable member shown in FIG. 4;

FIG. 6 is an enlarged perspective view of a flange assembly that is part of the play apparatus shown in FIGS. 1 and 2;

FIG. 7 is an enlarged exploded view of the flange assembly shown in FIG. 6;

FIG. 8 is a sectional view of the flange assembly shown in FIG. 6 and taken along the lines 8—8;

FIG. 9 is a perspective view of play apparatus that is a second embodiment of the invention;

FIG. 10 is a sectional view of a recessed rung that is part of the play apparatus shown in FIG. 9 taken along the lines 10–10; and FIG. 11 is a perspective view on an alternative embodiment of the second inclined surface that is part of the play apparatus shown in FIGS. 1 and 9.

DETAILED DESCRIPTION OF THE PREFERRED EMBODIMENTS

Figure 1:
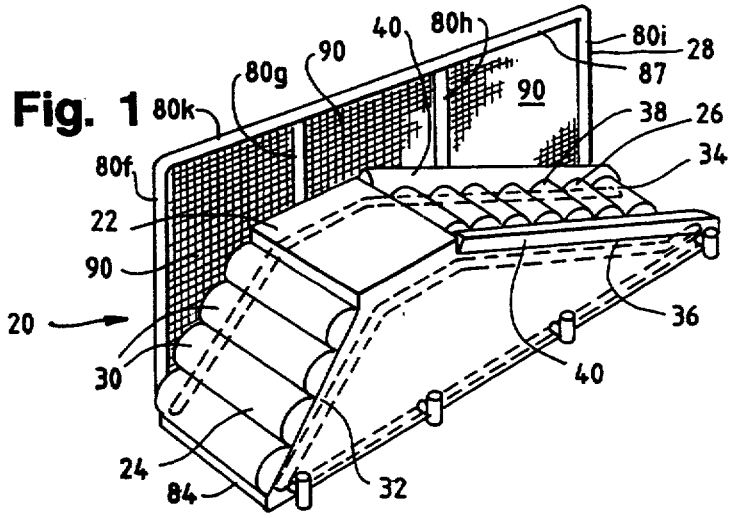
FIG. 1 is a perspective view of play apparatus that is one embodiment of the invention.
Figure 2:
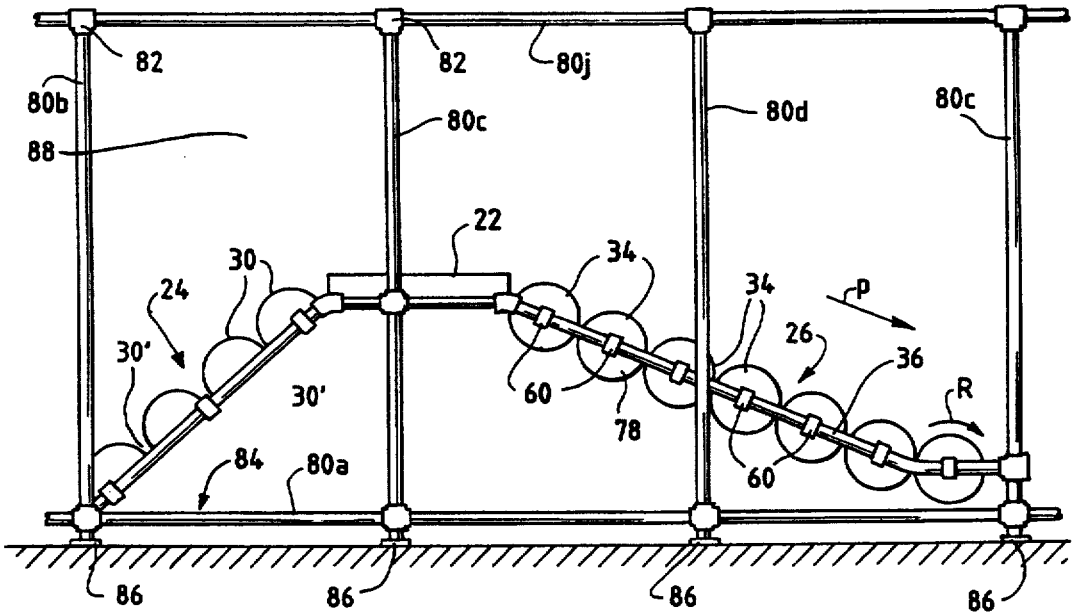
FIG. 2 is a right side elevation view of the play apparatus shown in FIG. 1.

FIG. 1 is a perspective view of play apparatus 20 that is one embodiment of the invention. Play apparatus 20 has an elevated platform 22 from which a first and a second inclined surface 24 and 26, respectively, depend. Elevated platform 22 and first and second inclined surfaces 24 and 26 may be supported by any suitable superstructure, such as frame 28. First inclined surface 24 has a plurality of bolsters or cylindrical ridges 30 extending transversely across and are supported by an underlaying 32 of first inclined surface 24. Underlaying 32 may be of plywood secured to a metal frame (not shown) and may be of dimensions such as forty-five by forty-eight inches. Alternatively, bolsters 30 may be self-supporting (not shown). It will be observed that ridges are adjacent to form a continuous surface having a plurality of recessed hand and foot supports (i.e., the recessed area 30' where adjacent cylinders 30 abut one another, as best seen in FIG. 2). The particular advantage to this arrangement is discussed below in connection with FIG. 9.

Depending on the age and skill level of children for whom play apparatus 20 is built, first inclined surface 24 should form a thirty to forty-five degree angle with the horizontal ground. A more gentle incline is better suited for younger children who may have difficulty with steeper inclines.

Second inclined surface has a plurality of adjacent rotatable members 34 extending transversely across the longitudinal extent of second inclined surface 26. For clarity, not every padded roller illustrated in the Figures is indicated by a reference numeral. Referring to FIGS. 1 and 2, it will be seen that second inclined surface includes first and second inclined support members 36 and 38 which are connected to elevated platform 22 at their respective upper ends and to frame 28 at their respective lower ends. Optional handrails 40 are made of vinyl-covered, relatively dense foam, and are mounted to second inclined surface 26 by any suitable structure which may be the novel structure discussed below.

Figure 4:
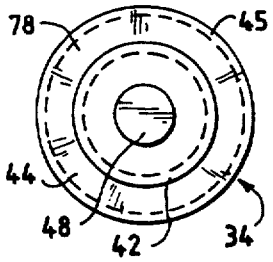
FIG. 4 is a side view of the padded rotatable member shown in FIG. 3.
Figure 3:
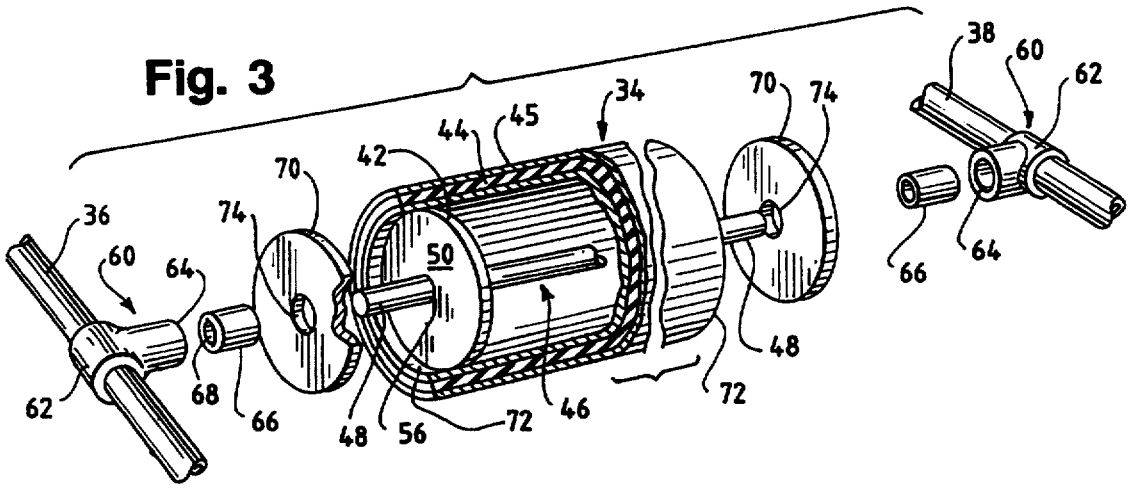
FIG. 3 is an exploded cut-away view of one of the padded rotatable men, hers and its corresponding mounts that are part of the play apparatus shown in FIG. 1.

First and second inclined support members 36 and 38 are in spaced, parallel relation to define an elongated path P therebetween. Plurality of rotatable members 34 are transversely disposed across path P to provide a surface for sliding and climbing. The structure of each one of rotatable members 34 is best seen in FIGS. 3 and 4. Each rotatable member has a cylindrical tubular body 42 which may be eight-inch PVC pipe. A padding material 44, preferably moderately dense foam, surrounds tubular body 42, and a vinyl sleeve 45 encases padding material 44.

An axle assembly 46, best seen in FIG. 5 is coaxially mounted within each rotatable member 34 for permitting rotation about the center longitudinal axis thereof. Axle assembly 46 comprises an elongated axle 48 (preferably of metal) and three disk-shaped plates 50, 52 and 54 which receive axle 46 through center apertures 56, and which are welded into position on axle 48 at each opposing longitudinal end and at the middle, respectively, as shown in FIG. 5. Plates 50–54 are of a diameter equal to the diameter of the interior bore of tubular body 42, so that when axle assembly 46 is disposed in tubular body 42, axle 46 is coaxial with tubular body 42.

Plates 50–54 may be of metal or other suitable material, and each has welded to it two right-angled mounting brackets 58. Each of brackets 58 are preferably located along the periphery of each of plates 50–54 at diametrically opposing sides thereof. Brackets (and thereby plates 50–54) are mounted to rotatable member by means of screws, bolts or other suitable fasteners.

A plurality of mounts 60 are attached to first and second inclined support members 36 and 38 at regular intervals, and rotatably engage axle assemblies 46 of each rotatable member, as seen in FIGS. 2 and 3. For clarity, it should be noted that not every mount 60 illustrated in the Figures is indicated by a reference numeral. Referring to FIG. 3, each of mounts 60 comprises a clamp 62 which is secured to one of inclined support members 36 and 38. Clamp 62 may be a conventional T-shaped pipe clamp, such as the Models 10-8 or 16-8 manufactured by Kee Industries. When clamp 62 is mounted to one of inclined support members 36 and 38, it provides a hollow tube 64 extending at right angle from one of support members 36 and 38. A bushing 66 is snugly inserted into tube 64, and receives one end of axle 48, as shown in FIG. 3. The other end of axle 48 is similarly engaged by a mount 60 located on the other one of inclined support member 36 and 38, thereby rotatably mounting axle 48 between two of mounts 60.

Preferably, each of bushings 66 in each of mounts 60 located along inclined support member 36 is equipped with well-known commercially available one-way roller clutches 68. Clutches 68 permit rotatable members 34 to rotate only in the direction indicated by the arrow R of FIG. 2. This facilitates and encourages movement of children along second inclined surface 26 in a predetermined direction. Each of bushings 66 in mounts 60 located along inclined support member 38 need not be equipped with a one-way roller clutch, but rather may have commercially available roller bearings (not shown). Suitable roller bearings and clutches are commercially available, including the Model RCB121616 from the Torrington Company, Torrington, Conn.

The advantage to allowing rotatable members 34 to rotate in only one direction is that play apparatus 20 may be used in conjunction with other play apparatus as part of a path or course through which children progress. By encouraging children to move over play apparatus 20 in a single direction, the flow of children along the path or course is facilitated. Also, as a safety feature, it is desirable that children not be attempting to climb up second inclined surface 26 while other children are rolling down second inclined surface 26.

As best seen in FIG. 3, plugs 70 (which may be of wood or other suitable material) are snugly inserted into longitudinal ends 72 of rotatable members 34. Each plug 70 has a bore 74 in coaxial alignment with rotatable member 34 through which the ends of axle 48 may extend. Tubular body 42 has a plurality of peripherally disposed apertures (not shown) at each of longitudinal ends 72 in alignment with each of plugs 70. The apertures receive screws to allow securing engagement of the screws into plugs 70. As best seen in FIG. 4, a plate 78 (which may be of PVC), having a central aperture for receiving axle 48 is suitably secured over each of plugs 70 to cap each longitudinal end 72 of each rotatable member 12. The diameter of plate 78 is sufficiently large to cover the entire cross-section of rotatable member 12, and serves to cover sharp edges of tubular body 42, padding material 44 and vinyl sleeve 45.

Referring back to FIGS. 1 and 2, it will be noted that frame 28 is constructed from plurality of metal bars including bars 80*a*–80*k* which may be of any suitable construction, such as standard two-inch metal pipe. Bars 80*a*–80*k* are conventionally connected by a plurality of clamps or sleeve connectors 82 to form a suitable superstructure for play apparatus 20. Any suitable structure or method of connecting bars 80*a*–80*k* can be utilized. For clarity, it should be noted that not every clamp 82 illustrated in the Figures is designated by a reference number. In particular, frame 28 includes a rectangular base 84 (formed in part by bar 80*a*) and plurality of vertical support bars 80*b*–80*i* extending upwardly therefrom. Vertical support bars 80*b*–80*i* are connected together for support at their upper ends by horizontal support bars 80*j* and 80*k* of base. The lower ends of vertical support bars 80*b*–80*i* may extend past base 84 to provide feet 86 upon which play apparatus 20 can stand.

Metal bars 80*a*–80*k* are preferably covered by jackets 87 of foam padding (preferably of polyethylene). As a conventional, jackets 87 may have a longitudinal slit (not shown) which enables them to be placed around metal bars 80*a*–80*k*. Jackets 87 may be secured to bars 80*a*–80*k* with electrical ties or other suitable fasteners. Each jacket 87 may be covered by a vinyl sleeve.

It will be observed that the vertical support bars 80*b*–80*i* define an interior region 88 in which elevated platform 22 and first and second inclined surfaces 24 and 26 are disposed. Nets 90 are conventionally strung between vertical support bars 80*b*–80*i* to partially enclose interior region 88. Elevated platform 22 and inclined surfaces 24 and 26 are of a width such that their respective longitudinal sides are adjacent to nets 90. In this manner,the nets restrain children from falling off elevated platform 22 or inclined surfaces 24 and 26.

In connecting nets 90 to bars 80*b*–80*i*, a variety of techniques may be used. For example, the edges of nets 90 may be provided with a grommet-bearing flange. A line or cord can then be laced through the grommets and around one of bars 80*b*–80*i*. It will be noted that the longitudinal slits of jackets 36 can be used to accommodate the line or cord connecting nets 90 to bars 80*b*–80*i*.

For clarity, it should be noted that in FIGS. 1 and 9 vertical support bars 80*b*–80*e* and nets 90 spanning therebetween are not completely shown so that other components of play apparatus 20 are more clearly visible. It should also be noted that FIG. 2 is a right side elevation of play apparatus 20 that is a mirror image of the left side and that nets 90 and handrails 40 are not shown in FIG. 2 to better illustrate other components of play apparatus 20. Moreover, bars 80*a*–80*g* are illustrated in FIG. 2 without padding jackets 87 to reveal clamps 82 which are otherwise not visible.

Turning now to FIG. 6, the connection of sets 90 to the rest of play apparatus 20 is now discussed. FIG. 6 is an enlarged perspective view of a flange assembly 92. Flange assembly 92 extends from each of the side edges of elevated platform 24 and first and second inclined surfaces 24 and 26 and securely engages nets 90 to the rest of play apparatus 10. Thus, flange assembly 92 prevents children on play apparatus 20 from slipping between the nets 90 and the elevated platform 22 or inclined surfaces 24 and 26.

Flange assembly 92 comprises grommet-bearing flanges 94 which extend from the side edges of elevated platform 22 and first and second inclined surface 24 and 26. Each flange 94 is of pliable material such as vinyl, which is suitably of attached to the rest of play apparatus 20 by stitching or other suitable fasteners. Flanges 94 may be made of one long continuous flange, or may be comprised of segments corresponding to the elevated platform 22, and the first and second inclined surfaces 24 and 26.

As best seen in FIG. 7, the upper portion of each flange 94 is folded over and secured together at 96' in a suitable manner. This can be accomplished by sewing, by adhesively securing or otherwise to provide an elongated sleeve 96 in which a thin, elongated aluminum extrusion or bracket 98 is inserted. Extrusions 98 have a plurality of apertures 100 spaced at intervals along their respective longitudinal extent. Apertures 100 are alignable with grommets 102 of flanges 94.

Flange assembly 92 also includes a plurality of flanges or edges 104 which are suitably mounted to portions of nets 90 near the intersection of nets 90 and flanges 94. Each of edges 104, formed as described with respect to sleeve 96, includes a sleeve 106 into which an extrusion or bracket 108 is inserted. Extrusion 108 has a plurality of apertures 110 which are alignable with grommets 112 spaced along edges 104 and also with the apertures 100 of extrusion 98. Flanges 92 and net edges 104 are secured together by aligning each of apertures 100 with a corresponding one of apertures 110, and each of grommets 102 with a corresponding one of grommets 112, and inserting therethrough rivets 114 or other suitable fasteners as best seen in FIGS. 7 and 8.

As discussed above, second inclined surface may include vinyl-covered foam handrails 40. Flanges 94 extending along second inclined 26 surface may be sewn or otherwise suitably fastened to the side of handrails 40. As best seen in FIG. 8, conventional straps 116 are then connected to each of handrails 40 at spaced intervals along the lower edge of each of handrails 40. Straps 116 are then tied or otherwise suitably fastened to the adjacent one of first and second inclined support members 36 and 38.

FIG. 9 is a perspective view of play apparatus 117 in accordance with a second embodiment of the invention. An inclined surface 118 is provided having a plurality of spaced-apart padded cylindrical wells 120 suitable for receiving the hands and feet of a child and extending over the length and width of inclined surface 118. Wells 120 are preferably about eight inches in diameter and six inches deep.

Even more so than the cylindrical ridges or bolsters 30 used in the first embodiment 20, wells 120 are especially suitable for developing children's hand-eye coordination because children must position their hands or feet with precision in order to engage wells 120. However, because the wells are on an inclined (as opposed to vertical surface), a child will, in all likelihood, not fall off inclined surface 118 if he or she misplaces a hand or foot. Thus, the present invention allows the child to take perceived risks (such as in grasping toward a well) without actually compromising the child's physical safety. The taking of such perceived risks builds the child's sense of confidence and self-esteem, as well as develops his or her coordination.

Inclined surface 118 may be constructed of an underlayment 122 which may be a plywood sheet supported by a metal frame (not shown). The plywood sheet and the metal frame are suitably clamped to inclined support members 36 and 38 which descend from elevated platform 22. A padded mat 124 is placed over underlayment 122. Mat 124 has a plurality of apertures 126, each of which defines the location of one of wells 120. The thickness of mat 124 defines the depth of wells 120.

FIG. 10 illustrates the construction of one of recessed wells 120. As can be seen, each well has a cylindrical tube 128, which may be a short section of cylindrical PVC pipe. The diameter and length of each tube 128 are approximately equal to the diameter and depth, respectively, of each aperture 126. A one-inch layer of foam padding 130 lines the interior of tube 128. A lower end of the tube 128 has a bottom portion 131 which may be formed by welding a disk-shaped base to the interior wall of tube 128. Each tube 128 is placed in one of wells 12a with its bottom 129 flush against underlayment 122.

A vinyl sheet 132 is provided for covering padded mat 124. Vinyl sheet includes sewn-in pockets 134 which are sized and located for snug insertion into each of cylindrical tubes 128. To complete assembly of inclined surface 118, vinyl sheet 132 is placed over padded mat 124, and pockets 134 are inserted into each of cylindrical tubes 128. A disk-shaped plug 136 (see FIG. 10) is then placed flush against bottom 129 of each one of tubes 128. Each plug 136 and bottom 129 includes a center aperture 138 for receiving a carriage bolt 140 (see FIG. 10). Bolt 140 is inserted through plug 136, base 129 and underlayment 122, and is received by washer 142 and nut 144. In this manner, the tubes 128 and padding 130 and pockets 134 therein are secured to particular locations on underlayment 122 which correspond to the locations of apertures 126 of mat 124.

It will be observed that apertured mat provides a continuous surface which includes a plurality of hand and foot supports, just as do cylindrical ridges 30 (described above in connection with play apparatus 20). The advantage to having a continuous surface (as opposed to a discontinuous surface such as rungs of a ladder) is that a child cannot overextend a hand or foot through a hand or foot support such as one of wells 120. Thus, a child is less likely to slip or fall while traversing inclined surface 118 (or inclined surface 24). In addition to promoting safety, this improves the child's chances of successfully negotiating inclined surface 118 (or inclined surface 24) and reinforces his or her self-confidence.

FIG. 11 is a perspective view of an alternative embodiment of the second inclined surface 26 that is part of the play apparatus shown in FIG. 1 and 9. In accordance with this embodiment, an inclined surface 146 is provided in which adjacent rotatable members 34 of play apparatus 20 or 117 are replaced by a planar center portion 148 suitable for use as a slide.

While the invention has been described herein with respect to certain preferred embodiments, it is to be understood that the invention is capable of numerous changes, modifications and rearrangements without departing from the invention as defined in the claims. For example, frame 28 may be replaced with a variety of structures, and fabric of mesh, (such as nylon) may replace netting 90.

What is claimed is:

1. Play apparatus, comprising:

a first inclined surface having a continuous surface which defines a plurality of hand and foot holds;

a second inclined surface comprising a plurality of adjacent rotatable members extending transversely across said second inclined surface and first and second inclined support members, said support members being elongated, spaced apart, and depending from said elevated platform portion, wherein each of said support members has a plurality of means for rotatably mounting said rotatable members, and wherein each of said plurality of rotatable members is mounted at each of its longitudinal ends to one of said support members by said mounting means and wherein said rotatable members include an axle extending from each longitudinal end thereof; and wherein said plurality of mounting means associated with said first inclined support member each includes a bushing for rotatably engaging one of said axles, a clamp for securing said bushing to said first support member, and means disposed within said bushing for allowing said axle to rotate within said bushing only in a single direction; and an elevated platform portion, wherein said first and second inclined surfaces depend from said elevated platform portion.

2. Play apparatus, comprising:

a first inclined surface having a continuous surface which defines a plurality of hand and foot holds;

a second inclined surface comprising a plurality of adjacent rotatable members extending transversely across said second inclined surface;

an elevated platform portion, wherein said first and second inclined surfaces depend from said elevated platform portion;

restraining means adjacent to said inclined surfaces for preventing children thereon from falling off, said restraining means comprising a plurality of nets and a frame having a plurality of vertical frame members, said nets being mounted to each of said vertical frame members to span said vertical frame members;

a first flange connected to at least one of said elevated platform, said first inclined surface and second inclined surface; and a second flange connected to at least one of said nets; and said first and second flanges being adapted for mating engagement with each other.

3. Play apparatus, comprising:

a first inclined continuous planar surface having a plurality of spaced apart padded wells of a size and depth suitable for receiving the entire hands or feet of a child and extending over the length and width of said first inclined planar surface;

a second inclined surface;

an elevated platform portion, wherein said first and second inclined surfaces depend from said elevated platform portion;

restraining means adjacent to said inclined surfaces for preventing children thereon from falling off, said restraining means comprising a plurality of nets and a frame having a plurality of vertical frame members, said nets being mounted to each of said vertical frame members to span said vertical frame members;

a first flange connected to at least one of said elevated platform, said first inclined surface and second inclined surface; and a second flange connected to at least one of said nets; and said first and second flanges being adapted for mating engagement with each other.

4. Play apparatus, comprising:

a first inclined surface having an underlayment portion and a continuous surface defined by a plurality of adjacent cylinders extending transversely across said first inclined surface, wherein said cylinders are longitudinally bisected and have at least one flat surface, said bisected cylindrical members being mounted by their respective said flat surfaces to said continuous surface, and said cylinders being sized to provide hand and foot holds in the area between adjacent ones of said cylinders;

a second inclined surface comprising a plurality of adjacent rotatable members extending transversely across said second inclined surface;

an elevated platform portion, wherein said first and second inclined surfaces depend from said elevated platform portion;

a frame having a base and a plurality of vertical members peripherally disposed around the base and extending upward therefrom to define an interior region therebetween;

a plurality of nets strung between said plurality of vertical members to partially enclose said interior region;

a platform portion mounted to at least one of said plurality of vertical members for elevation above said base;

a first flange connected to at least one of said elevated platform portion, said first inclined surface and second inclined surface; and a second flange connected to at least one of said nets; and said first and second flanges being adapted for mating engagement with each other.

* * * * *